US005610985A

United States Patent [19]

Ten Kate

[11] Patent Number: 5,610,985

[45] Date of Patent: Mar. 11, 1997

[54] DIGITAL 3-CHANNEL TRANSMISSION OF LEFT AND RIGHT STEREO SIGNALS AND A CENTER SIGNAL

[75] Inventor: Warner R. T. Ten Kate, Eindhoven, Netherlands

[73] Assignee: U.S. Philips Corporation, New York, N.Y.

[21] Appl. No.: 184,323

[22] Filed: Jan. 21, 1994

[30] Foreign Application Priority Data

Jan. 22, 1993 [EP] European Pat. Off. ..... 93200156

[51] Int. Cl.[6] ..... H04S 3/00

[52] U.S. Cl. ..... 381/27; 381/2

[58] Field of Search ..... 381/27, 19–23, 381/2

[56] References Cited

U.S. PATENT DOCUMENTS

| | | | |
|---|---|---|---|
| 4,024,344 | 5/1977 | Dolby et al. | 381/27 |
| 4,408,095 | 10/1983 | Ariga et al. | 381/27 |
| 4,980,915 | 12/1990 | Ishikawa | 381/27 |
| 5,113,447 | 5/1992 | Hatley et al. | 381/27 |
| 5,161,210 | 11/1992 | Druyvesteyn et al. | 395/2 |
| 5,251,260 | 10/1993 | Gates | 381/27 |

FOREIGN PATENT DOCUMENTS

| | | |
|---|---|---|
| 0372601 | 6/1990 | European Pat. Off. . |
| 9000338 | 2/1990 | Germany . |
| 9001128 | 5/1990 | Germany . |

OTHER PUBLICATIONS

"Matrixing of Bit Rate Reduced Audio Signals" by Ten Kate et al, Proc. ICASSP 1992, Mar. 23–16, vol. 2, pp. II–205–208.

"High Definition Sound For High Definition Television", by D. Mears, Proc. of the AES 9th International Conference, 1991, pp. 187–215.

Meares, "High Definition Sound for High Definition Television", AES 9th International Conference, pp. 187–215.

*Primary Examiner*—Stephen Brinich
*Attorney, Agent, or Firm*—Edward W. Goodman

[57] ABSTRACT

System for digital transmission of left and right stereo signals and a center signal through left and right stereo channels and an auxiliary channel, respectively. In order to substantially reduce the extra bandwidth necessary to transmit the center signal while maintaining the possibility of a proper reproduction of the center signal, a selection of a first and a second centerpart signal is provided, the frequency spectrum thereof being respectively located in a frequency range of the center signal below and above a cut-off frequency, the cut-off frequency being related to the transmission capacity of the auxiliary channel, the first of these centerpart signals being transmitted through the auxiliary channel for reproduction at the receiver side through a center speaker unit, at least the second of these centerpart signals being transmitted together with the left and right stereo signals through the left and right stereo channels, respectively, the second centerpart signal being combined with the left and right stereo signals into, respectively, left/center and right/center signals for reproduction at the receiver side through left and right speaker units, simultaneously with the reproduction of the first centerpart signal through the center speaker unit.

22 Claims, 2 Drawing Sheets

Figure 1:
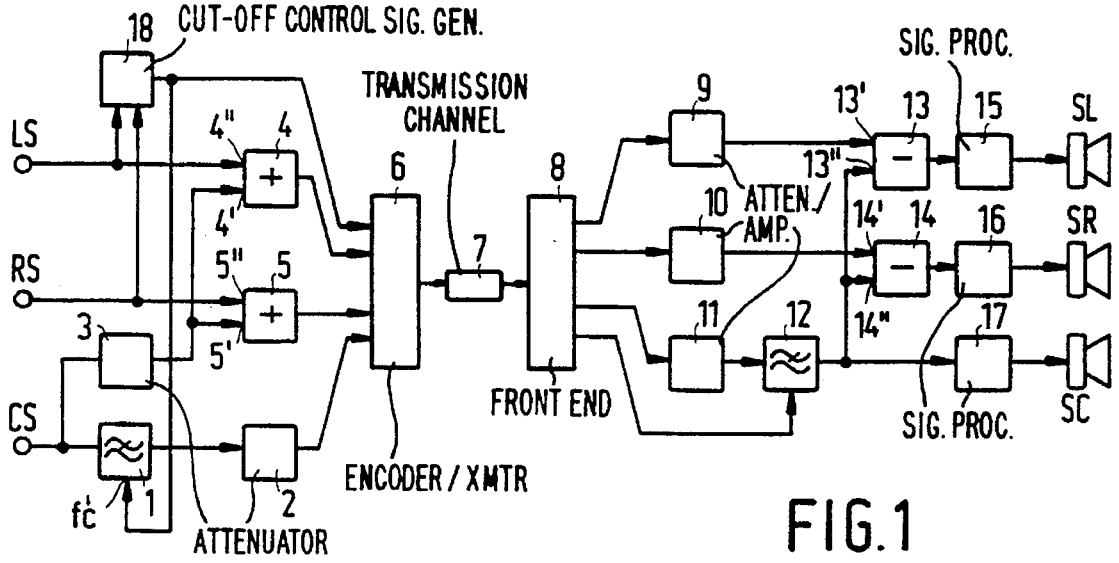

DIGITAL 3-CHANNEL TRANSMISSION OF LEFT AND RIGHT STEREO SIGNALS AND A CENTER SIGNAL

The invention relates to a system for digital transmission of left and right stereo signals and a center signal through left and right stereo channels and an auxiliary channel respectively, as well as to a transmitter and receiver for cooperation in such system. The term "transmission" is to be understood to include the storage of such signals on a record carrier, the transmitter operating as a recording device executing the steps of recording and storing the above signals on a record carrier and the receiver operating as a player, reading out and the signals from the record carrier. In this connection the invention also relates to a transmission medium in the form of a record carrier. The invention further relates to a method of transmitting left and right stereo signals and a center signal through left and right stereo channels and an auxiliary channel respectively, a composite sound signal for conveying left and right stereo signal information and center signal information.

The above system is on itself known in various applications e.g. in multichannel sound systems and/or in future TV systems. By way of example reference is made to the article "High definition sound for high definition television" by D. Meares, published in Proceedings of the AES 9th international conference, pages 187–215, 1991.

The center signal in the known systems is picked up at a center location of the scene and thereafter transmitted in its full frequency range through (or stored in) the auxiliary channel. Simultaneously the full range center signal is added eventually after a certain level adjustment to each of the left and right stereo signals and thereafter transmitted through the left and right stereo-channels. In a two speaker-unit or stereophonic type audio reproduction system, such as applied in e.g. a D2MAC television receiver as described in e.g. Technical Document 3258-E of the European Broadcasting Union, entitled "Specification of the systems of the MAC/packet family", published in October 1986, the received left stereo-signal and center signal combination on the one hand and the right stereo signal and center signal combination on the other hand are respectively supplied to left and right speaker units for a two-channel stereo reproduction.

With such two speaker-unit type reproduction of stereo sound signals the center signal is presented as a phantom sound source, which may virtually be located somewhere in between the left and right stereo speaker-unit dependent on e.g. the difference in loudness between the left and right stereo signals. When dealing with stereo sound signals accompanying a television signal the location of said phantom source should match with the location of the visible image of the television receiver within certain limits, also when the left and right speaker-units are placed not immediately next to the television screen but some meters away therefrom. With the known two speaker-unit type television receiver, however, the virtual location of the phantom source depends strongly on the position of the listener with regard to the location of left and right speaker-units. The phantom sound source may therewith be virtually located away from the location of the television screen.

A stabilisation of the location of the phantom source on the location of the television screen is achieved by reproducing the center signal with a center speaker unit, placed at or near the location of the television screen. This occurs with a multichannel sound receiver having at least three speaker units, such as a triphonic type television receiver, operating at the receiver side in the first mentioned known system. Such triphonic type television receiver provides for the reproduction of the left and right stereo signals through respectively left and right speaker units, the center signal being reproduced through a center speaker unit.

The above known system requires an overall transmission capacity or bandwidth exceeding that of a two channel stereosound system not exhibiting the future of a separate reproduction of the center signal, e.g. as applied in the before-mentioned D2MAC system, with the bandwidth of the auxiliary channel. Due to the ever growing need for more information to be transmitted on the one hand and the limited availability of transmission bandwidth on the other hand, there is a continuous strive to keep the required transmission bandwidth as small as possible. This can be achieved to a certain degree by using a proper source coding technique, which strongly reduces the bitrate of the signals in question. However, along with the so obtained bitrate reduction artefacts in the reproduction of the coded signals at the receiver side are introduced, which, from a certain bitrate reduction factor on will become unacceptably noticeable. At the present state of the an this puts a limit to the reduction of the required transmission bandwidth.

It is a first object of the invention to reduce the bandwidth required for the transmission of a center signal in the above known system, eventually in addition to a reduction achieved with a source coding technique, while maintaining the possibility of a properly perceptible reproduction of this center signal at the receiver side.

A system according to the invention is therefore characterized by a selection of a first and a second centerpart signal, the frequency spectrum thereof being respectively located in a frequency range of the center signal below and above a cut-off frequency, said cut-off frequency being related to the transmission capacity of the auxiliary channel, the first of these centerpart signals being transmitted through the auxiliary channel for reproduction at the receiver side through a center speaker unit, at least the second of these centerpart signals being transmitted together with the left and right stereo signals through the left and right stereo channels, respectively, the second centerpart signal being combined with the left and right stereo signals into, respectively, left/center and right/center signals for reproduction at the receiver side through left and right speaker units, simultaneously with the reproduction of the first centerpart signal through the centerspeaker unit.

A transmitter according to the invention for transmitting left and right stereo signals and a center signal through left and right stereo channels and an auxiliary channel respectively, said signals being respectively supplied by left and right stereo signal sources and a center signal source, is therefore characterized in that the center signal source is coupled to a low pass selection means having a cut-off frequency related to the transmission capacity of the auxiliary channel for selecting a first centerpart signal having a frequency spectrum located in the frequency range of the center signal below said cut-off frequency, this first centerpart signal being supplied for transmission to the auxiliary channel, the center signal source being coupled to first inputs of first and second signal combination means, second inputs of these first and second signal combination means being connected to the left and right stereo signal sources and outputs of said first and second signal combination means being connected to the left and right stereo channels, respectively.

A receiver according to the invention for cooperation with such transmitter comprising first to third signal processing means for processing signals received respectively through the left and right stereo channels and the auxiliary channel, is characterized by first and second subtracting means, first inputs thereof being coupled to outputs of the first and second signal processing means, second inputs thereof being commonly coupled to an output of the third signal processing means, outputs thereof supplying the difference between the received combination of the left stereo signal and the center signal on the one hand and the first centerpart signal on the other hand, respectively, the received combination of the right stereo signal and the center signal on the one hand and the first centerpart signal on the other hand, to left and right signal terminals for connecting thereto left and right stereo signal reproduction means, the first centerpart signal being supplied from the third signal processing means to a center signal terminal for connecting thereto a center signal reproduction means.

A transmitter according to the invention for transmitting left and right stereo signals and a center signal through left and right stereo channels and an auxiliary channel respectively, said signals being respectively supplied by left and right stereo signal sources and a center signal source may alternatively be characterized in that the center signal source is coupled via a high pass selection means to the first inputs of said first and second signal combination means, this high pass selection means having a cut-off frequency equal to the one of the low pass selection means for selecting a second centerpart signal having a frequency spectrum located in the frequency range of the center signal above said cut-off frequency, this second centerpart signal being combined in said first and second signal combination means with each of the left and right stereo signals into left/center and right/center signals, respectively, to be supplied to the left and right stereo channels, respectively.

A receiver for cooperation with the latter transmitter may comptise first to third signal processing means for processing signals received respectively through the left and right stereo channels and the auxiliary channel and may be charactetized in that the first to third signal processing means are coupled through first to third filtering means to terminals for connecting thereto left, right and center speaker units respectively, the cut-off frequency of said filming means corresponding to the bandwidth of the left/center and right/center stereo signals and the first centerpart signal, respectively.

The invention is based on the recognition that the human perception of a center signal reproduced through a center speaker unit in its full frequency range does not or only hardly noticeably differ from a reproduction of the center signal, in which the higher frequency range of this center signal are being reproduced through left and right stereo speaker units and the lower frequency range through a center speaker unit positioned in-between the left and right stereo loudspeaker units.

By using the measure according to the invention the transmission of the second centerpart signal being added to the left and right stereo signals requires no extra transmission bandwidth and therewith no extra transmission capacity compared with the known two channel stereo soundsystem, whereas the first centerpart signal having a much smaller frequency range than the complete center signal can be coded with a much smaller number of bits than this complete center signal. The bandwidth or transmission capacity of the auxiliary channel can therewith be much smaller than without using this measure.

As the transmission capacity of the auxiliary channel can be very small, the above measure according to the invention makes it possible e.g. to use more or less incidentally occurring redundant bits in the left and right stereo signals for the transmission of the first centerpart signal. An identification of such redundant bits, can be achieved by using hidden channel techniques as disclosed in e.g. the article "Matrixing of bit rate reduced audio signals" by W. R. Th. ten Kate et al, published in Proc. ICASSP, 1992, Mar. 23–26, San Francisco, Calif., Volume 2, pages II-205–208 and European patent application nr. 89202823.

A transmitter according to the invention, which makes use of such hidden channel techniques is characterized in that the left and right stereo signals are supplied to a cut-off frequency control signal generator comprising a hidden capacity detector for deriving a cut-off frequency control signal from the hidden channel capacity of the left and right stereo signals, an output of this cut-off frequency control signal generator being connected to a cut-off frequency control input of each of said selection means for controlling the cut-off frequency thereof, outputs of said first and second signal combination means as well as the output of the low pass selection means being coupled to inputs of an encoding device of the hidden channel coding type, the transmitter supplying the output signal of the encoding device together with an indicator identifying said cut-off frequency.

If downward compatibility with existing two-speaker receivers is a requirement, then the complete center signal, i.e. the first and second centerpart signals should be added to each of the left and right stereo signals before transmission. These two-speaker receivers then reproduce the left stereo signal and center signal combination through their left speaker unit and the right stereo signal and center signal combination through their right speaker unit.

In multichannel receivers the left/center and right/center signals can be derived from the received left stereo signal and center signal combination, the right stereo signal and center signal combination and the first centerpart signal by properly matrixing these received signals.

A receiver for cooperation with the latter transmitter, in which transmitter the left/center and right/center stereo signals are formed, is characterized by a decoding device of the hidden channel decoding type, deriving the left/center and right/center stereo signals and the first centerpart signal from the received signals, as well as by means for detecting the cut-off frequency from the received cut-off frequency indicator coupled to a control input of said third filtering means.

The above measure to reduce the required overall transmission bandwidth in accordance with the invention is preferably combined with the use of bitrate reduction coding techniques such as subband coding and transform coding. This is achieved in a transmitter being characterized in that the outputs of the first and second signal combination means are coupled to a first bitneed determining means for identifying the number of bits needed after compression of the output signals of the first and second signal combination means in accordance with a bitrate reduction coding technique, the center signal being supplied to a second bitneed determining means for identifying as a function of the cut-off frequency the number of bits needed after compression of the first centerpart signal, outputs of these first and second bitneed determining means being coupled to a cut-off frequency control signal generator comprising a comparator for determining the maximum value of the cut-off frequency at which the left and right stereo signals and the first centerpart signal can be accommodated in the available transmission capacity of the left and right stereo channels and the auxiliary channel respectively, outputs of said first and second signal combination means as well as the output of the low pass selection means being coupled to inputs of a bitrate reduction encoding device, the transmitter supplying the output signal of the encoding device together with an indicator identifying said cut-off frequency.

By using this measure the bandwidth of the auxiliary channel can be dynamicly adapted to that part of the transmission bandwidth, which is not occupied by the other coded sound signal components like the left and right stereo signals and eventually speech signals. An optimal continuously adapting trade-off between the perceptual effect of the center signal on the one hand and the available transmission bandwidth can therewith be achieved. Preferably subband coding in accordance with the ISO/MPEG layer I and/or II for the encoding of the left and right stereo signals is being used.

The first and second bimeed determining means may correspond to the bitneed determining means known from e.g. the European patent application No. 91201088 (PHN 13329).

A receiver for cooperating with the latter transmitter in a system according to the invention is characterized by a source decoder preceding the first to third signal processing means as well as by means for detecting the cut-off frequency from the received cut-off frequency indicator coupled to a control input of said third filtering means.

The latter control is optional: for reason of simplicity it is very well possible to achieve acceptable results with a proper chosen predetermined fixed value for the cut-off frequency of the third filtering means.

It is furthermore possible to apply the measure according to the invention to the D2MAC television system standard as defined in e.g. the abovementioned Technical Document 3258-E of the European Broadcasting Union. This D2MAC system provides like the above known system for the transmission of 16 kHz bandwidth (i.e. 32 kHz sampling rate) left and right stereo signals together with a number of additional digital commentary or speech signals with a bandwidth of 8 kHz (i.e. 16 kHz sampling rate).

Such system is preferably characterized in that the first centerpart signal is combined with a speech signal into a speech/center signal being transmitted through the auxiliary channel.

A transmitter operating in such system is characterized in that the output of the low pass selection means and a speech signal source are connected to respectively first and second inputs of a further signal combination means, an output thereof being coupled to the auxiliary channel.

By using this measure the first centerpart signal is added to preferably each of the speech signals transmitted, the second centerpart signal being added to each of both left and right stereo signals. This requires no extra bandwidth compared to the known D2MAC system.

Furthermore the measure when applied within the D2MAC system secures full compatibility with the known D2MAC television receiver as the latter—being in fact a two speaker television receiver—combines the received speech/center combination signal and the left/center and right/center combination signals into left/center/speech and right/center/speech signals respectively for reproduction through the left and right speaker units.

In a receiver for cooperating with the latter transmitter the signals received respectively through the left and right stereo channels and the auxiliary channel and processed in first to third signal processing means are respectively coupled to left and right signal terminals for connecting thereto left and right stereo signal reproduction means, the third signal processing means supplying a speech/center signal to a center terminal for connecting thereto a speech/center signal reproduction circuit.

With such three speaker television receiver a proper reproduction of the center signal can be achieved, which in perceptance does not or only to a very minor degree differs from a reproduction of the full range center signal from the center speaker unit.

Further aspects of the invention provide a method of transmitting left and right stereo signals and a center signal through left and right stereo signals and an auxiliary channel respectively, as defined in claims 17 or 18; a composite sound signal for conveying left and right stereo signal information and center signal information as defined in claim 19; a record carrier comprising the composite sound signal of claim 19; and the receiver as defined in claim 21.

The invention will be described in greater detail and by way of example with reference to the Figures shown in the drawing. Corresponding elements are herein provided with the same reference indications.

Figure 1A:
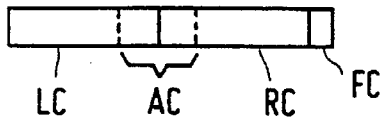
Figure 2:
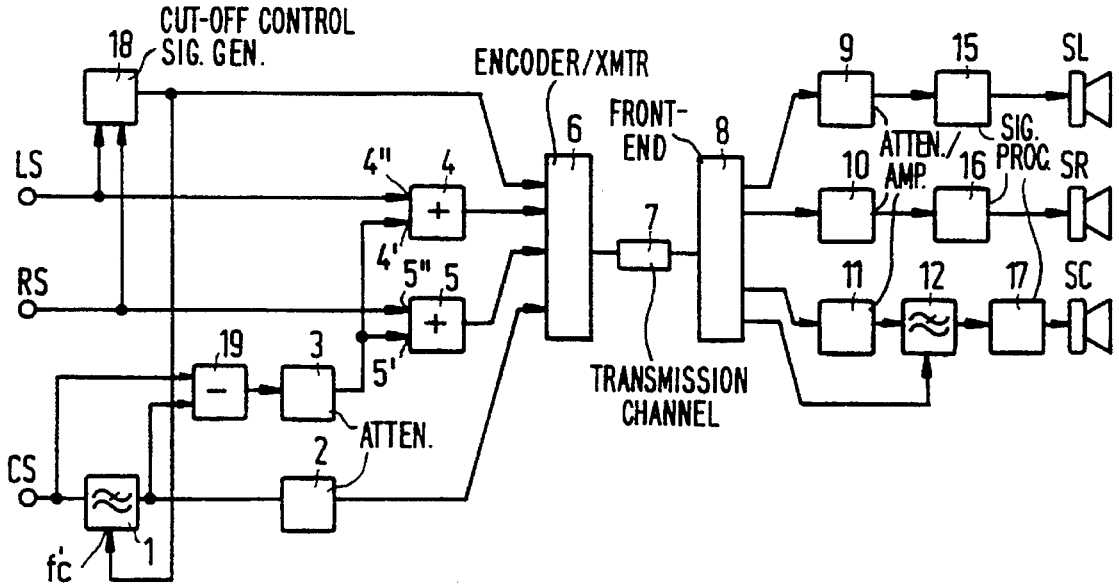
Figure 3:
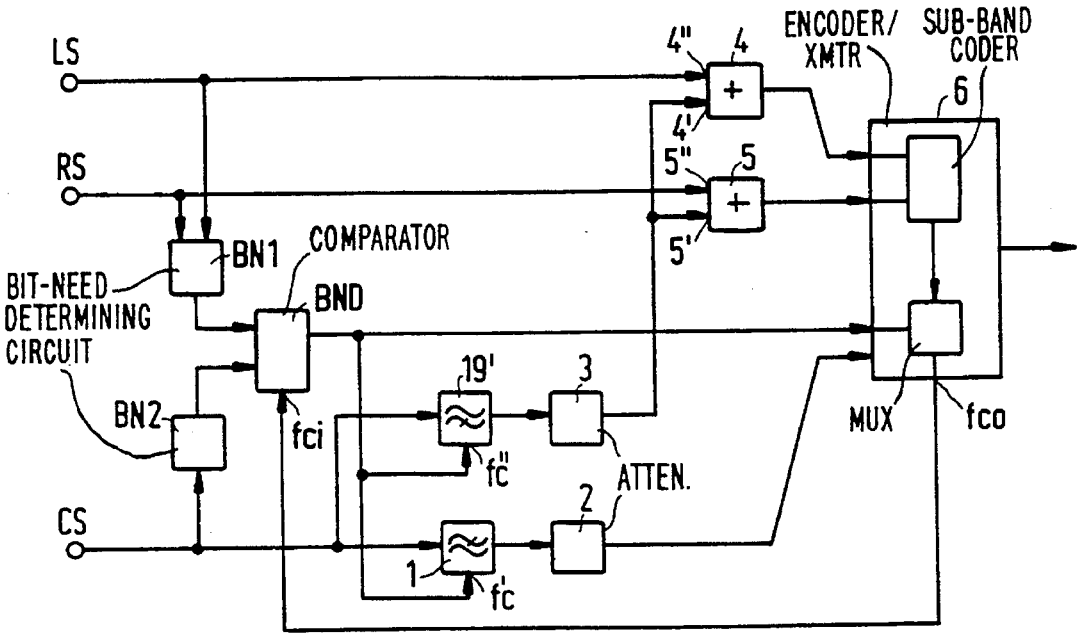
Figure 3A:
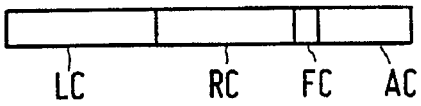
Figure 4:
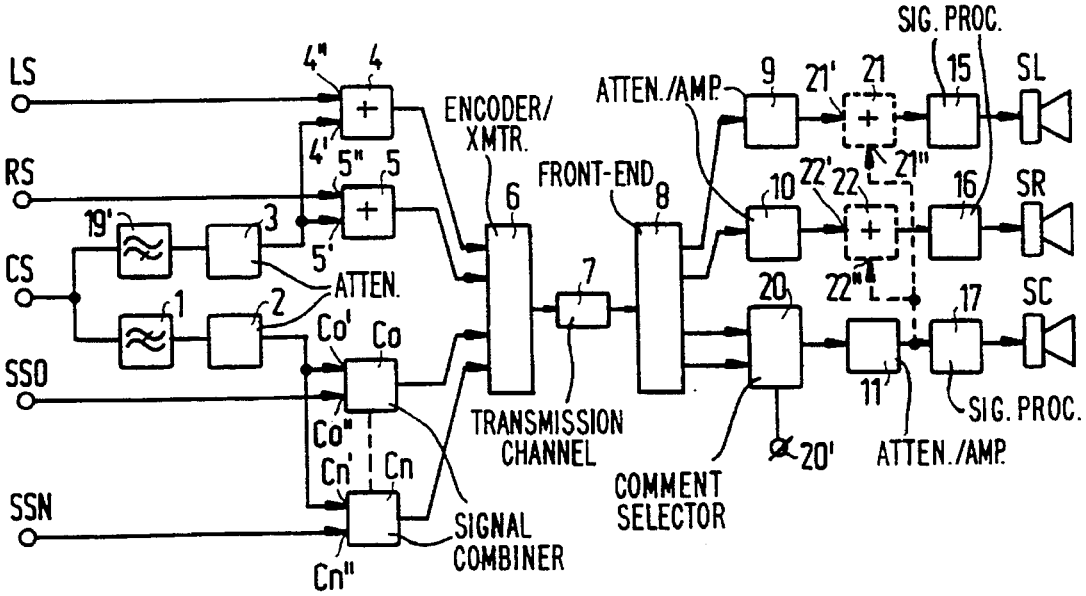

This drawing shows in:

FIG. 1 a first system comprising a transmitter and receiver according to the invention, which makes use of hidden channel techniques;

FIG. 1A the transmission channel structure;

FIG. 2 a second system comprising a transmitter and receiver according to the invention;

FIG. 3 a transmitter according to the invention in which a bitrate reduction technique is applied;

FIG. 3A the transmission channel structure of the signal provided by said further transmitter;

FIG. 4 a third system comprising a transmitter and receiver according to the invention, which can be applied in TV multichannel soundsystems.

FIG. 1 shows a system according to the invention comprising a transmitter 1–6, 18, a transmission channel 7 and a receiver 8–17. The transmitter is supplied with left and right stereo signals L and R and a center signal C from left and right stereo signal sources LS and RS and a center signal source CS, respectively. L, R and C are mutually independent in the sense that they are picked up with separate microphones located at a left, right and center position with regard to the soundscene. L, R and C are hereinafter also referred to as original audio signals and may be digital signals each having e.g. an bandwidth of 16 kHz and a sampling rate of 32 KBit/sec.

The center signal C from CS is supplied to a low pass selection means 1, which may be constituted by a low pass filter, having a transition or cut-off frequency fc, chosen within the frequency range of the center signal C. The pan of the center signal C, selected by this low pass selection means 1, is hereinafter referred to as first centerpart signal CP1, the remaining pan as second centerpart signal CP2. The first centerpart signal CP1 is coupled through first attenuation means 2 with attenuation factor a1 to an encoder/transmitter-endstage 6, the attenuated first centerpart signal a1.CP1 being supplied to this encoder/transmitter-endstage 6.

The center signal C from CS is also supplied through second attenuation means 3 with attenuation factor a2 to first inputs 4' and 5' of first and second signal combination means 4 and 5, respectively. These first and second signal combination means 4 and 5 may be constituted by summation circuits.

The left and right stereo signals L and R from the left and right stereo signal sources LS and RS are supplied to second inputs 4" and 5" of said first and second signal combination means 4 and 5, respectively. In the first signal combination means 4, L and a2.C are combined into the signal L+a2.C and in the second signal combination means 5, R and a2.C are combined into the signal R+a2.C. Outputs of the first and second signal combination means 4 and 5 are coupled to the encoder/transmitter-endstage 6 for supplying thereto the signals L+a2.C and R+a2.C. The encoder/transmitter-endstage 6 effectuates a frequency- or timedivision multiplexing of the signals L+a.2.C, R+a.2.C and a1.CP1 for transmission through time- or frequency multiplexed left and right stereo channels and an auxiliary channel LC, RC and AC respectively. These multiplexed signals are then applied to the transmission channel 7 for transmission to the receiver 8–17. If the cut-off frequency fc is fixed at a predetermined value, than this value need of course not be transmitted.

The attenuation factors a1 and a2 are preferably chosen such that the amplitude or signal energy of a1.CP1 equals the summation of the amplitudes or signal energies of the a2.C components in L+a2.C and R+a2.C. This level adjustment can also be achieved (not shown) by using only one of said attenuation means and/or one amplifier and a proper choice of the attenuation respectively gain factor thereof.

The attenuation/amplification of CP1 and C in the attenuation means 2 and 3 has no effect on the bandwidth of these signals, so that in bandwidth CP1 equals a1.CP1 and C equals a2.C. Also the addition of a2.C to L and R in the first and second signal combination means 4 and 5 have no effect on the bandwidth of the original signals L and R, so that in bandwidth L+a2.C equals L and R+a2.C equals R, provided of course that the bandwidth of C does not exceed that of L and R. As the attenuation factors a1 and a2 are merely used for achieving a proper audio level adjustment and play no role in the reduction of the necessary transmission bandwidth, these factors are set to unity in the following in order to simplify the explanation of the invention.

The bandwidth of the first centerpart signal CP1 is smaller than that of the complete center signal C. Consequently the transmission capacity or bitrate necessary for transmitting CP1 can be substantially smaller than that necessary for transmitting C. This also holds when coding techniques are applied: the transmission capacity or bitrate necessary for transmitting CP1 after using a certain source coding technique remains smaller than that necessary for transmitting C, provided of course that the same coding technique is applied. This means that with the above measure of transmitting separately from L and R only the first centerpart signal CP1 instead of the complete center signal, the transmission bandwidth of the auxiliary channel AC only needs to be sufficiently large to accommodate the first centerpart signal CP1 therein. The overall transmission bandwidth can therewith be substantially smaller than that in the above prior art system, in which the complete center signal C is transmitted through the auxiliary channel.

The multiplexed signals L+C, R+C and CP1 are supplied from the transmission channel 7 to a receiver front end 8. The receiver front end 8 comprises a demultiplexer (not shown) for demultiplexing and/or demodulating the signals L+C, R+C and CP1, which signals are respectively applied to third to fifth attenuation/amplification means 9–11 for adjusting the amplitudes of said signals to proper values. The third and fourth attenuation/amplification means 9 and 10 are coupled to first inputs 13' and 14' of first and second differential stages 13 and 14, functioning as a dematrixing circuit. Outputs of these differential stages 13 and 14 are coupled through first and second audiosignal processors 15 and 16 to left and right stereospeaker units SL and SR. The fifth attenuation/amplification means 11 are coupled to a low pass filter 12 having a cut-off frequency equal fc for adequately selecting the first centerpart signal CP1. This selected first centerpart signal CP1 is thereafter supplied on the one hand to second inputs 13" and 14" of the differential stages 13 and 14 and on the other hand through an audiosignal processor 17 to centerspeaker unit SC. With properly chosen attenuation factors of the third to fifth attenuation/amplification means 9–11, left/center and right/center signal L+a.CP2 and R+a.CP2 are formed in the first and second differential stages 13 and 14, which signals are further processed and reproduced in the first and second audiosignal processors 15 and 16 and the left and right stereospeaker units SL and SR. The centerspeaker unit SC is located in between the left and right stereospeaker units SL and SR and reproduces the first centerpart signal CP1. By varying the factor a the balance in level between CP2 and CP1 can be controlled. It appears in practice that within a large range of values of the cut-off frequency fc, reproduction of the left/center and right/center signal L+a.CP2 and R+a.CP2 and the first center signal CP1 does not noticeably differ from reproduction of the original signals L, R and C. The value of fc may be chosen at e.g. half the bandwidth of the signals L and/or R.

If fc is varied e.g. depending on the bandwidth available for transmission of CP1, then an indicator for identifying fc should also be transmitted. This cut-off frequency indicator can be used in the receiver for varying the cut-off frequency of the low pass filter 12 for a proper selection of the first center signal CP1. A variation of the transmission bandwidth available for CP1 may occur when using certain coding techniques for encoding the signal combinations to be transmitted i.e. L+C and R+C, as will be further described hereinafter.

Due to the relatively small transmission capacity required for the auxiliary channel, one of the coding techniques which can be advantageously applied is the socalled hidden channel coding technique. This technique is applied in the system shown in FIG. 1 and is on itself known from e.g. the above EP application No. 89 202 823 (PHN 12903). For details on the functions related to this technique and the circuitry realizing these functions reference is made to this European patent application. For a proper understanding of the embodiment as shown in FIG. 1 it is sufficient to know that this coding technique makes use of the psycho-acoustic masking levels of an audio signal, such as the L and R signals to identify signalbits therein carrying signal information of minor or no importance. These socalled unused or unoccupied signalbits also referred to as hidden channel, can be used to carry another signal, i.e. the first centerpart signal CP1. The determination of the capacity of the hidden channel i.e. the number of the unused signalbits, takes place in an hidden capacity detector included in a cut-off frequency control signal generator 18. Inputs of this hidden capacity detector are coupled to the left and right stereo signal sources LS and RS. The result of this determination is applied as a frequency control signal to a frequency control input fc' of the low pass selection means 1 for varying the cut-off frequency fc thereof depending on the available capacity of the hidden channel of L and R. This results in a dynamic adaptation of the bandwidth of the first centerpart signal CP1 to the available capacity of the hidden channel of L and R.

The addition of the center signal C to L and R in the first and second signal combination means 4 and 5, respectively, results in an increase of the masking levels. This means that the hidden capacity of L+C and R+C is larger than that of L and R. As in fact the hidden capacity of L+C and R+C is determining for the bandwidth of the first centerpart signal CP1, which can be accommodated, the above cut-off frequency fc of the lowpass pass selection means 1 can be increased to a certain extend to achieve a further optimization in the use of this hidden channel capacity. This can be effected e.g. by a proper adjustment of the frequency control signal applied to the frequency control input of these low-pass pass selection means 1.

An insertion of the first centerpart signal CP1 in the hidden channel of L+C and R+C takes place in an hidden channel encoder of the transmitter endstage 6. If necessary the first centerpart signal CP1 is first encoded e.g. in accordance with the audio coding ISO/MPEG audio standard Layer 1 or Layer 2 before being applied to the transmitter endstage 6. The encoder necessary therefore can be combined with the first attenuation means 2.

An indicator fcx identifying the cut-off frequency fc should also be transmitted in order to be able to derive therefrom at the receiver side said cut-off frequency fc. For this purpose the frequency control signal output of the hidden capacity detector of the cut-off frequency control signal generator 18 is also coupled to the transmitter endstage 6.

The format of the output signal of the transmitter endstage 6 is shown in FIG. 1A. In this format the signals L+C, R+C, CP1 and the cut-off frequency indicator fcx is shown in a time division multiplex structure, wherein between solid line is shown the left stereo transmission channel LC, the right stereo transmission channel RC, the transmission channel FC for the cut-off frequency indicator fcx and the auxiliary channel between dotted vertical lines accommodating the first centerpart signal CP1 located in the hidden channels of L+C and R+C. The capacity or bandwidth of LC, RC and FC is fixed, whereas the bandwidth of the auxiliary channel varies with the hidden channel capacity of L and R.

The receiver front end 8 at the receiver side provides in addition to the beforementioned above functions also the derivation of the cut-off frequency information from the cut-off frequency indicator fox. This cut-off frequency information is not only used in the decoder of the receiver front end 18 to properly decode the signals L+C, R+C and CP1 but is also supplied as a frequency control signal to a frequency control input of the variable lowpass filter 12 for a dynamic variation of the cut-off frequency to the bandwidth of the first centerpart signal CP1.

The present system is downwards compatible with prior an stereo receivers, in which no dematrixing of the left/center and right/center signals L+C and R+C and no processing of the first center signal CP1 occur and in which only the signals L+C and R+C are processed and reproduced.

If downward compatibility is not required then it is possible to form the left/center and right/center signals L+a.CP2 and R+a.CP2 in the transmitter as applied in the system of FIG. 2. In order to select the second centerpart signal CP2 use is made of high pass selection means 19, which may be constituted by a differential stage for forming the difference between the complete center signal C at the input of the low pass selection means 1 and the first centerpart signal CP1 at the output of said low pass selection means 1. In the first and second signal combination means 4 and 5 the above left/center and right/center signals L+a.CP2 and R+a.CP2 axe now obtained and further processed as described above in connection with the system of FIG. 1. It is of course also possible to use a high pass filter (not shown) connected between the center signal source SC and the attenuation means 3 as high pass selection means. The low and high pass selection means 1 and 19 constitute a perfect reconstruction filter pair, so that upon addition of the selected CP1 and CP2 the original signal C is retrieved without distortion. In the receiver cooperating with this transmitter the use of differential stages is avoided, the third and fourth attenuation/amplification means 9 and 10 being coupled through the first and second audiosignal processors 15 and 16 to left and right stereospeaker units SL and SR and the fifth attenuation/amplification means 11 being coupled through subsequently the low pass filter 12 and the audiosignal processor 17 to the centerspeaker unit SC.

The system shown in FIG. 3 differs from that shown in FIGS. 1 and 2 in that instead of the hidden channel coding technique the coding technique known from European patent application nr. 90201356 (PHN 13241) is applied. For details on the functions related to this coding technique, also referred to as subband coding, and the circuitry realizing these functions reference is made to the latter European patent application. For a proper understanding of the embodiment as shown in this FIG. 3 it is sufficient to know that with this coding technique redundant and irrelevant audio information can be excluded from the bitstreams of digital audio signals—such as the signals to be transmitted L/L+C/L+CP2, R/R+C/R+CP2 and CP1—resulting in a substantial bitrate compression without noticeable loss of sound information. The number of bits needed for the coded audio signal can be determined from the original audio signal in a socalled bitneed determining means.

In the transmitter the left and right stereo signal sources LS and RS are coupled to inputs of a first bitneed determining means BN1, whereas the center signal source CS is coupled to an input of a second bitneed determining means BN2. In BN1 the minimum number of bits (bn1) needed to represent L and R without noticeable loss of information—also indicated as L and R signal bitneed—is determined and supplied to a comparator BND. In BN2 the same occurs with the center signal C in the sense that BN2 determines the bitneed for the first centerpart signal CP1 at various values of the cut-off frequency fc (bn2[xi]). The subsequent values of the cut-off frequency fc are preferably chosen such that the frequency ranges between each two subsequent frequency values fx(i+1)-fxi correspond to the socalled audio subbands. The frequency range of each such subband may cover a bandwidth of e.g. 500 Hz. The bitneed values of the first center signal CP1 at each above subsequent value of the cut-off frequency fc, i.e. the cumulative bitneed value of CP1 per subband within C are supplied to the comparator BND.

In the comparator BND an estimation of fc is made in accordance with the following equation:

$$\sum_{xi=0}^{fc} bn2\{xi\} \leqq (\text{Available number of bits}) - bn1$$

Here from the subband x of the center signal C can be determined for which the cumulative bitneed value equals the difference between the overall transmission capacity of the transmission channel 7 (i.e. the available number of bits) on the one hand and the bitneed value of the L and R signals on the other hand. The information of the upper frequency of this subband x is supplied from the output of the comparator BND as a frequency control signal to the frequency control input fc' of the low pass selection means 1 and a frequency control input fc" of high pass selection means 19'. These selection means 1 and 19' have mutually corresponding cut-off frequencies, which vary equally with the latter frequency control signal and are used to select the first and second centerpart signals CP1 and CP2 respectively.

The left/center and right/center signal s L+CP2 and R+CP2 resulting from the addition of the second centerpart signal CP2 to the left and right stereo signals L and R in the first and second signal combination means 4 and 5 are coded in a subband coder (not shown) included in the transmitter endstage 6. However, due to the addition, it may occur that the bitneed of L+CP2 and R+CP2 deviates from that of L and R. If the bitneed of L+CP2 and R+CP2 is equal or smaller than that of L and R, then in the transmitter endstage encoding of L+CP2, R+CP2 and CP1 according to the above subband coding technique may be executed, followed by multiplexing and modulating operations resulting in a time division multiplex channel structure as shown in FIG. 3A. Herein the number of bits divided over the left and right stereo channels LC and RC and the auxiliary channel for transmission of the first center signal may mutually vary. The information for this variation is carried by the cut-off frequency indicator fcx, allocated in the channel FC. In the receiver the encoded signals L+CP2, R+CP2 and CP1 are decoded and thereafter processed similar to the signal processing in the circuits 9–12, 15–17 of the receiver shown in FIG. 2.

If the bitneed of L+CP2 and R+CP2 exceeds that of L and R, then an iterative estimation of the cut-off frequency fc can be made, by lowering the cut-off frequency fc per each iteration cycle with a certain predetermined frequency step, which may e.g. equal a subband frequency range. For this purpose a control feed back loop is provided from an iteration control output fco of the transmitter endstage 6 to an iteration control input fci of the comparator BND for e.g. decreasing the number of available bits in the above equation.

If, however, only incidentally the bitneed of L+CP2 and R+CP2 is in excess of that of L and R, then instead of iteratively lowering the cut-off frequency fc, the first centerpart signal CP1 and/or the signals L+CP2 and R+CP2 to be transmitted can be coded with a somewhat smaller number of bits than strictly necessary to avoid quantisation noise from becoming noticeable.

FIG. 4 shows another system comprising a transmitter and receiver according to the invention, which can be applied in e.g. in multilingual sound systems and/or in future TV systems as known from the first mentioned article "High definition sound for high definition television" by D. Meares, published in Proceedings of the AES 9th international conference, pages 187–215, 1991. Such systems provide for the transmission of a number of various speech signals, e.g. comment signals in different languages. The speech signals are transmitted through speech channels, each being substantially smaller than an audio channel such as the left or right stereo channels. Normally the bandwidth of a speech channel (e.g. 8 kHz) is half the bandwidth of an audio channel (16 kHz).

In the transmitter of this second system the cut-off frequency fc of the low and high pass selection means 1 and 19' is fixed at a predetermined value, corresponding to the bandwidth of the speech channel. It is therefore not necessary to transmit information with regard to the cut-off frequency fc. The first centerpart signal CP1 at the output the first attenuation means 2 is supplied to first inputs C0' to Cn' of further signal combination means C0 to Cn respectively. A number of n speech signals S0 to Sn is supplied from speech signal sources SS0 to SSn to second inputs C0" to Cn" of the further signal combination means C0 to Cn, respectively. In the further signal combination means C0 to Cn, the speech signals S0 to Sn are each added to the (attenuated) first centerpart signal CP1, resulting in n speech/center signal s S0+CP1 to Sn+CP1, respectively. In the present situation the attenuation factor of the first attenuation means 2 is set to unity. The bandwidth of these speech/center signal s S0+CP1 to Sn+CP1 equals that of the original speech signals S0 to Sn, respectively. Furthermore, as explained above, the bandwidth of the left/center and right/center stereo signal L+CP2 and R+CP2 obtained in the first and second signal combination means 4 and 5, equals that of the original left and right stereo signals L and R. Consequently no extra bandwidth is necessary for accommodating and transmitting the first and second centerpart signal CP1 and CP2, compared with the systems as described in the latter article in which no center signal is being transmitted.

The receiver front end 8 derives the signals L+CP2, R+CP2 and S0+CP1 to Sn+CP1 from the received time division multiplexed signals. The signals L+CP2 and R+CP2 are supplied through the third and fourth attenuation means 9 and 10 to the first and second audiosignal processors 15 and 16, followed by the left and right stereo speaker units SL and SR. The speech/center signal s S0+CP1 to Sn+CP1 are coupled to a comment selector device 20 for selecting one desired speech or comment signal Si from these signals. The control for this signal selection can be realized by applying a selection control signal to a comment selection control input 20' of the comment selector device 20.

In a three channel receiver the selected speech/center signal Si+CP1 is supplied through the fifth attenuation means 11 to the audiosignal processor 17, followed by a reproduction in the centerspeaker unit SC. By locating the centerspeaker unit SC in between the left and right stereo speaker units SL and SR a proper three channel reproduction of L+CP2, R+CP2 and Si+CP1 is achieved, which is hardly distinguishable from a three channel reproduction of L, R and Si+C.

In a normal prior art stereophonic receiver the signals L+CP2 and R+CP2 are supplied from the third and fourth attenuation means 9 and 10 to first inputs 21' and 22' of third and fourth signal combination means 21 and 22 (see dotted boxes). The comment signal Si is supplied through the fifth attenuation means 11 to second inputs 21" and 22" of these third and fourth signal combination means 21 and 22 (through the dotted connection lines). Therein Si+CP1 is added to L+CP2 and R+CP2, respectively, resulting in left/center/speech and right/center/speech signals L+Si+C and R+Si+C. These left/center/speech and right/center/speech signals L+Si+C and R+Si+C are thereafter supplied through the first and second audio-signal processors 15 and 16 to the left and right stereo speaker units SL and SR for reproduction. This means that the transmission system of FIG. 4 is downwards compatible with two speaker-unit TV receivers.

The invention is not restricted to transmission systems as such, but also includes recorder/player systems and in general systems for storage and retrieval of surround sound signals using at least three channels. In the latter sense transmitter is to be understood to include recording and/or other storing devices, receiver to include player and/or other reading devices and transmission channel to include any transmission and/or storage medium of optical, magnetic or other nature such as e.g. tapes, discs or solid state memories.

The invention is applicable with other systems, such as four and five channel sound systems.

I claim:

1. A system for digital transmission of left and right stereo signals and a center signal through left and right stereo channels and an auxiliary channel, respectively, characterized in that said system comprises:

means for providing a left and right stereo signal and a center signal;

left and right stereo transmission channels and an auxiliary transmission channel;

means for separating said center signal into a first and a second centerpart signal, a frequency spectrum of said first centerpart signal being located in a frequency range of the center signal below a cut-off frequency, and a frequency spectrum of said second centerpart signal being located above said cut-off frequency, said cut-off frequency being determined by a transmission capacity of the auxiliary transmission channel;

first means for transmitting the first centerpart signal through the auxiliary transmission channel;

means for combining the second centerpart signal with the left and right stereo signals into, respectively, left/center and right/center signals;

second means for transmitting said left/center signal and said right/center signal through said left and right stereo transmission channels, respectively;

a receiver coupled to said left and right stereo transmission channels and said auxiliary transmission channel for receiving said first centerpart signal; said left/center signal and said right/center signal, said receiver comprising:

means for subtracting said first centerpart signal from said received left/center signal and said right/center signal thereby forming a left signal and a right signal;

a left speaker unit and a right speaker unit coupled to said subtracting means for reproduction of the left and right signals; and a center speaker unit coupled to receive said first centerpart signal for reproduction of the first centerpart signal.

2. The system according to claim 1, characterized in that said left and right stereo signals have hidden channel capacity, and the center signal is accommodated within the hidden channel capacity of the left and right stereo signals.

3. The system according to claim 1 characterized in that said first and second means for transmitting each comprise means for performing a bit-rate reduction to code the signals being transmitted through the left and right stereo transmission channels and the signal being transmitted through the auxiliary transmission channel.

4. The system according to claim 1, characterized in that said system further comprises:

means for providing a speech signal; and means for combining the first centerpart signal with said speech signal into a speech/center signal for transmission through the auxiliary transmission channel.

5. Transmitter for transmitting left and right stereo signals and a center signal through left and right stereo transmission channels and an auxiliary transmission channel respectively, said signals being respectively supplied by left and right stereo signal sources and a center signal source, characterized in that the center signal source is coupled to a low-pass selection means having a cut-off frequency determined by a transmission capacity of the auxiliary transmission channel for selecting a first centerpart signal having a frequency spectrum located in the frequency range of the center signal below said cut-off frequency, this first centerpart signal being supplied for transmission to the auxiliary transmission channel, the center signal source being coupled to first inputs of first and second signal combination means, second inputs of these first and second signal combination means being connected to the left and right stereo signal sources and outputs of said first and second signal combination means being connected to the left and right stereo channels, respectively.

6. Transmitter according to claim 5, characterized in that the center signal source is coupled via high-pass selection means to the first inputs of said first and second signal combination means, said high-pass selection means having a cut-off frequency equal to the cut-off frequency of the low-pass selection means, said high-pass selection means selecting a second centerpart signal having a frequency spectrum located in the frequency range of the center signal above said cut-off frequency, said second centerpart signal being combined in said first and second signal combination means with each of the left and right stereo signals forming left/center and right/center signals, respectively, for transmission on the left and right stereo transmission channels, respectively.

7. Transmitter according to claim 5, characterized in that said low-pass selection means has a cut-off frequency control signal input for receiving a control signal for controlling the cut-off frequency, and said transmitter further comprises a cut-off frequency control signal generator having inputs coupled to receive the left and right stereo signals, said cut-off frequency control signal generator comprising a hidden capacity detector for deriving a cut-off frequency control signal from a hidden channel capacity of the left and right stereo signals, an output of this cut-off frequency control signal generator being connected to said cut-off frequency control input of at least the low-pass selection means for controlling the cut-off frequency thereof; and an encoding device for performing a hidden channel coding, said encoding device having inputs coupled to outputs of said first and second signal combination means and the output of the low-pass selection means, the transmitter supplying an output signal of the encoding device together with an indicator identifying said cut-off frequency to said transmission channels.

8. Transmitter according to claim 5, characterized in that the outputs of the first and second signal combination means are coupled to a first bit-need determining means for identifying the number of bits needed after compression of the output signals of the first and second signal combination means in accordance with a bit-rate reduction coding technique, the center signal being supplied to a second bit-need determining means for identifying, as a function of the cut-off frequency, the number of bits needed after compression of the first centerpart signal, outputs of said first and second bit-need determining means being coupled to a cut-off frequency control signal generator comprising a comparator for determining the maximum value of the cut-off frequency at which the left and right stereo signals and the first centerpart signal can be accommodated in the available transmission capacity of the left and right stereo channels and the auxiliary channel, respectively, outputs of said first and second signal combination means and the output of the low-pass selection means being coupled to inputs of a bit-rate reduction encoding device, the transmitter supplying an output signal of the encoding device together with an indicator identifying said cut-off frequency.

9. Transmitter according to claim 6, characterized in that the left and right stereo signal sources are coupled to a first bit-need determining means for identifying the number of bits needed after compression of the left and right stereo signals in accordance with a bit-rate reduction coding technique, the center signal being supplied to a second bit-need determining means for identifying, as a function of the cut-off frequency, the number of bits needed after compression of the first centerpart signal, outputs of said first and second bit-need determining means being coupled to a cut-off frequency control signal generator comprising a comparator for determining the maximum value of the cut-off frequency at which the left/center and right/center stereo signals and the first centerpart signal can be accommodated in the available transmission capacity of the left and right stereo transmission channels and the auxiliary transmission channel, respectively, outputs of said first and second signal combination means and the output of the low-pass selection means being coupled to inputs of a bit-rate reduction encoding device, the transmitter supplying an output signal of the encoding device together with an indicator identifying said cut-off frequency.

10. Transmitter according to claim 5, characterized in that the output of the low-pass selection means and a speech signal source are connected to, respectively, first and second inputs of a further signal combination means, an output thereof being coupled to the auxiliary transmission channel.

11. Receiver for cooperation with a transmitter according to claim 5, said receiver comprising first to third signal processing means for processing signals received, respectively, through the left and right stereo transmission channels and the auxiliary transmission channel, characterized in that said receiver further comprises first and second subtracting means having first inputs coupled to outputs of the first and second signal processing means, respectively, second inputs commonly coupled to an output of the third signal processing means, and outputs thereof supplying a difference between the received combination of the left stereo signal and the center signal, and the first centerpart signal, respectively, and a difference between the received combination of the right stereo signal and the center signal, and the first centerpart signal on the other hand, said outputs being coupled to left and right signal terminals for connection to left and right stereo signal reproduction means, the first centerpart signal being supplied from the third signal processing means to a center signal terminal for connection to a center signal reproduction means.

12. Receiver for cooperation with a transmitter according to claim 6, wherein said receiver comprises first to third signal processing means for processing signals received, respectively, through the left and right stereo transmission channels and the auxiliary transmission channel, characterized in that the first to third signal processing means are coupled through first to third filtering means to terminals for connecting thereto left, right and center speaker units, respectively, the cut-off frequency of said filtering means corresponding to the bandwidth of the left/center and right/center stereo signals and the first centerpart signal, respectively.

13. Receiver for cooperation with a transmitter according to claim 7, said receiver comprising first to third signal processing means for processing signals received, respectively, through the left and right stereo transmission channels and the auxiliary transmission channel, said receiver further having first and second subtracting means, first inputs thereof being coupled to outputs of the first and second signal processing means, second inputs thereof being commonly coupled to an output of the third signal processing means, outputs thereof supplying the difference between the received combination of the left stereo signal and the center signal, and the first centerpart signal, respectively, the received combination of the right stereo signal and the center signal, and the first centerpart signal to left and right signal terminals for connecting thereto left and right stereo reproduction means, the first centerpart signal being supplied from the third signal processing means to a center signal terminal for connecting thereto a center signal reproduction means, characterized in that said receiver further comprises a decoding device for performing a hidden channel decoding, said decoding device preceding the first to third signal processing means, and said receiver further comprising means for detecting the cut-off frequency from the received cut-off frequency indicator, said means for detecting having an output coupled to a control input of said third filtering means.

14. Receiver for cooperation with a transmitter according to claim 8, said receiver comprising first to third signal processing means for processing signals received, respectively, through the left and right stereo transmission channels and the auxiliary transmission channel, said receiver further having first and second subtracting means, first inputs thereof being coupled to outputs of the first and second signal processing means, second inputs thereof being commonly coupled to an output of the third signal processing means, outputs thereof supplying the difference between the received combination of the left stereo signal and the center signal, and the first centerpart signal, respectively, the received combination of the right stereo signal and the center signal, and the first centerpart signal to left and right signal terminals for connecting thereto left and right stereo reproduction means, the first centerpart signal being supplied from the third signal processing means to a center signal terminal for connecting thereto a center signal reproduction means, characterized in that said receiver further comprises a source decoder preceding the first to third signal processing means, and said receiver further comprising means for detecting the cut-off frequency from the received cut-off frequency indicator, an output of said means for detecting being coupled to a control input of said third filtering means.

15. Transmission medium in the form of a record carrier characterized in that the signals provided by the transmitter according to claim 5, have been recorded thereon, the average bandwidth of the auxiliary channel being smaller than that of each of the left and right stereo channels.

16. Transmission medium in the form of a record carrier according to claim 15, characterized by a registration of the cut-off frequency identifying indicator.

17. Method of transmitting left and right stereo signals and a center signal through left and right stereo transmission channels and an auxiliary transmission channel, respectively, characterized in that the method comprises the steps:

splitting-up the center signal into a first centerpart signal and a second centerpart signal, substantially comprising spectral components of the center signal below and above a cut-off frequency, respectively, said cut-off frequency determined by a transmission capacity of the auxiliary channel;

transmitting the first centerpart signal through the auxiliary transmission channel for reproduction at a receiver through a center speaker unit;

transmitting at least the second centerpart signal together with the left and right stereo signals through the left and right stereo transmission channels, respectively, the second centerpart signal being combined with the left and right stereo signals forming, respectively, left/center and right/center signals for reproduction at the receiver through left and right speaker units, simultaneously with the reproduction of the first centerpart signal through the center speaker unit.

18. Method of transmitting left and right stereo signals and a center signal through left and right stereo transmission channels and an auxiliary transmission channel, respectively, characterized in that the method comprises the steps:

subjecting the center signal to a low-pass selection having a cut-off frequency related to the transmission capacity of the auxiliary transmission channel for selecting a first centerpart signal substantially comprising spectral components of the center signal below said cut-off frequency;

supplying this first centerpart signal for transmission to the auxiliary transmission channel;

combining at least a part of the center signal and said left stereo signal to obtain a left stereo channel signal; and combining at least a part of said center signal and said right stereo signal to obtain a right stereo channel signal.

19. Method of transmitting left and right stereo signals and a center signal through left and right stereo transmission channels and an auxiliary transmission channel, respectively, characterized in that said method comprises the steps:

subjecting the center signal to a low-pass selection having a cut-off frequency determined by a transmission capacity of the auxiliary transmission channel for selecting a first centerpart signal substantially comprising spectral components of the center signal below said cut-off frequency;

supplying this first centerpart signal for transmission to the auxiliary transmission channel;

subjecting the center signal to a high-pass selection having a cut-off frequency substantially equal to the cut-off frequency of said low-pass selection, for selecting a second centerpart signal substantially comprising spectral components of the center signal above said cut-off frequency;

combining this second centerpart signal with each of the left and right stereo signals into left/center and right/center signals, respectively; and supplying said left/center right/center signals to the left and right stereo transmission channels, respectively.

20. A record carrier having recorded thereon a composite sound signal for conveying left stereo signal information, right stereo signal information and center signal information, characterized in that said composite sound signal comprises:

an auxiliary channel signal for conveying a low-frequency part of said center signal information;

a left channel signal for conveying a combination of said left stereo signal information and at least a high frequency part of said center signal information; and a right channel signal for conveying a combination of said right stereo signal information and at least the high frequency part of said center signal information.

21. Receiver for receiving the composite sound signal comprising an auxiliary channel signal for conveying a low-frequency part of said center signal information; a left channel signal for conveying a combination of said left stereo signal information and at least a high frequency part of said center signal information; and a right channel signal for conveying a combination of said right stereo signal information and at least the high frequency part of said center signal information, said receiver comprising first, second and third signal processing means for processing signals received, respectively, through the left and right stereo channels and the auxiliary channel, characterized in that said receiver further comprises:

first and second subtracting means having first inputs coupled to outputs of the first and second signal processing means, second inputs commonly coupled to an output of the third signal processing means, and outputs supplying a difference between the received combination of the left stereo signal and the center signal, and the first centerpart signal, and the received combination of the right stereo signal and the center signal, and the first centerpart signal on the other hand; and left and right signal terminals, coupled to the outputs of said first and second signal processing means, for connecting said receiver to left and right stereo-signal reproduction means, and a center signal terminal, coupled to an output of the third signal processing means carrying the first centerpart signal, for connecting said receiver to a center-signal reproduction means.

22. Receiver for receiving the composite sound signal comprising an auxiliary channel signal for conveying a low-frequency part of said center signal information; a left channel signal for conveying a combination of said left stereo signal information and at least a high frequency part of said center signal information; and a right channel signal for conveying a combination of said right stereo signal information and at least the high frequency part of said center signal information, said receiver comprising first, second and third signal processing means for processing signals received, respectively, through the left and right stereo channels and the auxiliary channel, characterized in that the first, second and third signal processing means are coupled through first, second and third filtering means, respectively, to terminals for connecting said receiver to left, right and center speaker units, respectively, the cut-off frequencies of said first, second and third filtering means corresponding to the bandwidth of the left/center and right/center stereo signals and the first centerpart signal, respectively.

* * * * *